US005247896A

United States Patent [19]

Vosper

[11] Patent Number: 5,247,896

[45] Date of Patent: Sep. 28, 1993

[54] LEAK-SAFE OIL TANKER

[76] Inventor: George W. Vosper, 149 Earl St., Kingston, Ontario, Canada, K7L 2H3

[21] Appl. No.: 788,384

[22] Filed: Nov. 6, 1991

[51] Int. Cl.[5] ..... B63B 25/12

[52] U.S. Cl. ..... 114/74 R

[58] Field of Search ..... 114/74 R, 74 A, 74 T, 114/256

[56] References Cited

U.S. PATENT DOCUMENTS

| | | | |
|---|---|---|---|
| 2,065,634 | 12/1936 | Warrick | 122/504 |
| 4,030,438 | 6/1977 | Telfer | 114/74 R |
| 4,157,072 | 6/1979 | West | 114/74 R |
| 4,241,683 | 12/1980 | Conway | 114/74 R |
| 4,347,798 | 9/1982 | Gallagher | 114/74 R |
| 5,101,750 | 4/1992 | Dumas | 114/74 R |

FOREIGN PATENT DOCUMENTS

| | | | |
|---|---|---|---|
| 2118091 | 4/1971 | Fed. Rep. of Germany | 114/74 R |
| 2031905 | 7/1971 | Fed. Rep. of Germany | 114/74 R |
| 147386 | 12/1938 | Japan | 114/74 R |

OTHER PUBLICATIONS

"Designing Tankers to Minimize Oil Spills", The New York Times, Jun. 17, 1990.

*Primary Examiner*—Sherman Basinger

*Attorney, Agent, or Firm*—Lowe, Price, LeBlanc & Becker

[57] ABSTRACT

A vessel for carrying a liquid cargo having a density less than that of the water supporting the vessel is provided with internal transverse and longitudinal bulkheads defining chambers of a total cargo storage space. A horizontal safety bulkhead extends longitudinally and transversely of the vessel and is connected to the sides, the end and intermediate transverse bulkheads and the longitudinal bulkheads, thereby forming the available liquid cargo storage space into a plurality of inner and outer upper and lower cells. This horizontal safety bulkhead is located to be below a predetermined waterline corresponding to a fully loaded condition of the ship, preferably at a distance between 5 ft. and 10 ft. below the waterline. Each of the upper and lower cells is individually vented to atmosphere. A suction pump applies suction to a suction line connected through one-way valves individually communicating with each of the inner and outer lower cells through openings in the horizontal safety bulkhead defining the same. The suction pump and the suction line are located between the waterline and the horizontal safety bulkhead to facilitate quick charging of the suction line with liquid cargo when the suction pump is operated. Rupture of the bottom or the side of the vessel at one of the lower cells at a point below the waterline is countered by operation of the suction pump and is assisted by the presence of a water head outside the rupture.

13 Claims, 4 Drawing Sheets

LEAK-SAFE OIL TANKER

TECHNICAL FIELD OF THE INVENTION

This invention pertains to a structure for a ship carrying liquid cargo. More specifically the invention is directed to a structural modification that will prevent, or substantially reduce, the leakage of liquid cargo in the event that the sides or bottom of the ship are ruptured.

BACKGROUND OF PRIOR ART

Ships built specifically to transport liquid cargoes in bulk have existed since the early 1900's. The majority of such vessels are used to carry crude oil or refined petroleum products. Until the 1960's their size was dictated by the limitations of the Suez Canal. After the Suez Crisis and the Arab-Israeli War the size of these ships increased dramatically to the point where bulk oil transports are now the largest ships afloat. Overall lengths in the order of a quarter of a mile and beams in excess of 200 feet have earned them the title "Supertanker". Fully loaded, many Ultra Large Crude Carriers (ULCC) have deadweight tonnages greater than the combined displacement of six "Nimitz" or "Eisenhower" class, nuclear powered aircraft carriers. Their extreme weight and length makes them ponderous to manuever. Once under way, it takes many miles to bring them to a halt. Drawing 80 to 90 feet, they are more prone to grounding than other vessels. The consequences of large volume oil spills are too well known. Their incredible cost in terms of lost cargo, clean-up expense and permanent environmental damage indicates there is a need for an effective solution. Considering the number of ULCC's plying the oceans, the potential for even larger spills is an ever present danger.

The risk of oil spills began with the launching of the first tanker. It is only the magnitude of recent spills that has caused world governments to seriously consider precautionary measures aimed at preventing their recurrence. Today's dominant global thinking is to mandate that all tankers have double hulls by some future date. However, double hulls are not a universally embraced solution. Building them into new ships or retrofitting existing tankers with inner hulls will be extremely expensive. Also, the cargo carrying capacity of double hulled ships is less than that of single skinned ships of the same displacement. The increased cost of double hulls, coupled with a reduced payload, will add to the cost of transporting oil. A more valid concern is that, while double hulls give a sense of absolute protection, they in fact do not. Considering the enormous momentum of a supertanker, it is highly probable that with a heavy grounding, both bottoms can be torn open. Similarly, it is likely that a severe collision would easily slice through both hulls.

In spite of the general belief that double hulls are the best insurance against future tanker spills, there is still a clear need for a means of preventing such spills that:

1. will be less expensive, both to retrofit in existing tankers or to build into new construction;
2. permits utilization of a tanker's cargo carrying capacity to its full potential; and
3. offers as good if not better protection against a wider variety of spill producing accidents.

The infrequency of major oil spills since the advent of the supertankers, has given credence to the opinion that they pose little risk and sustained the myth that clean-up facilities were adequate. That lack of spills until recently had reinforced the position of the oil industry that no special safety precautions were needed. In the past many anti-spill measures have been suggested, but none have succeeded in achieving any degree of acceptance or adoption by the shipping industry.

One such solution is found in U.S. Pat. No. 4,241,683, to Conway, titled "Liquid Cargo Tank Construction", which discloses a liquid cargo vessel having a hull comprising a bottom and sides, a top deck, and a number of transverse bulkheads disposed within the hull to form a plurality of water-tight cargo compartments between the top deck and the hull bottom. The specific improvement taught in this patent is the provision of a water-tight horizontal deck disposed within the hull between the top deck and the bottom deck above the waterline of the tank vessel and at a distance above the hull bottom which is less than or equal to $H(S_w S_c)$, where H represents the vertical height of the waterline of the vessel above the hull bottom, $S_w$ represents the specific gravity of water, and $S_c$ represents the specific gravity of the liquid cargo. The horizontal bulkhead constituting the improvement forms separate upper and lower water-tight liquid-receiving tanks within compartments above and below the waterline of the vessel.

In a vessel constructed as disclosed in the Conway patent, with the lower tank full, the pressure on the bottom due to the weight of the cargo will just equal the upward sea pressure against the hull. Should the tank's bottom be punctured, then with the outward and inward pressures in balance and because the oil will float on the heavier sea water, little or no cargo will escape. Had the tank been less than full, sea water coming in would force the cargo upward and no cargo would be lost. In that case a void will be left between the cargo surface and the top of the tank. If however that same vessel is holed at some point in its side above its bottom and below the waterline, the outward pressure of the cargo will be slightly greater than the inward sea pressure. The liquid contained within the holed compartment is inclined to flow out. This creates a below atmospheric pressure at the underside of the top of the damaged lower tank. If the cargo contains volatiles such as are frequently found in crude oil, or should the lower tank be vented to atmosphere, then the liquid's surface can move down from the tank's top. Cargo will flow out until a hydrostatic balance at the hole is reached. After that, cargo will continue to ooze out the upper part of the hole at the same rate seawater flows in the lower half of the hole and settles to the bottom of that side tank. This continues until all of the liquid cargo below the top of the hole has been displaced upwardly and out. The lost cargo will equal the air or vapor space above the remaining cargo plus all the oil that had been below the upper extremity of the opening. Should a lower side tank, as disclosed in the Conway patent, have a hole that extends close to the waterline, then virtually all the cargo in that damaged lower side tank will be lost.

SUMMARY OF THE INVENTION

A primary object of this invention is to prevent the initial out-rush of cargo when a tank is ruptured. With a safety deck located below the waterline, the outward pressure of the liquid cargo at any opening below that deck will always be less than the inward sea pressure. Thus there can be no initial tendency for the fluid cargo to pour out.

Another object of this invention is to retrieve and transfer fluid cargo from a damaged tank to buoyancy compartments, empty tanks or to floating elastomer containers. With the safety deck located below the waterline, the liquid cargo will be forced upward against the underside of that deck by the inward sea pressure. A void between the cargo's surface and the safety deck is therefore impossible. By locating the transfer pumps and their inlet piping at the level of the safety deck and attaching the pipes to openings through that deck then immediate pump suction is ensured.

A related object of this invention is to substantially reduce the spill potential from a side hole. When an opening occurs in the side of a tank below the safety deck, the sea will impart its pressure to the cargo until the inward and outward pressures are equal. That balance will occur at some point between the vertical extremities of the hole. Above that point, the sea pressure diminishes faster than the cargo pressure and below that neutral pressure condition the opposite occurs i.e., the inward sea pressure increases faster than the outward cargo pressure. Pressure at the top of the opening is outward and inward at the bottom. The cargo-seawater pressure differential is a function of the difference in their densities. It increases with the distance above, or below, the neutral condition. These forces are relatively small. Viscosity of the cargo is thus a significant factor in cargo loss. As the tank's volume is fixed, water can only flow in the bottom of the hole at the same rate oil escapes out the top. By pumping cargo out through the safety deck, the water inflow will increase and therefore the oil outflow through the opening must decrease. If the hole is not too large and the pumping capacity is sufficient, the outflow of cargo can be completely stopped. In the case of a large hole, if a mat is dropped below the hole and raised to cover it, then as flow is predominantly inward, the mat will be drawn in to the ships side. This effectively diminishes the size of the opening. Pumping can then appreciably abate or possibly stop cargo loss. Once the water-oil interface is above the top of the opening, pumping can be discontinued. The extent of the hole and particularly its upper limit can be sonically determined. Knowing the position of the top of the opening, an electrical probe, similar in function to U.S. Pat. No. 2,065,634 to Warrick, can be lowered into the damaged tank to that depth. The difference in conductivity of oil as compared with seawater will signal when the interface is above the top of the opening and pumping may be discontinued.

A further object of this invention is to provide a means of transferring cargo to and from tanker vessels at the loading and unloading terminals. The lower tanks, created by intermediate decks located below the waterline, can be filled or emptied in the same way subsea storage tanks are. To do this, controllable through-the-hull valves are installed in the bottoms of all lower cargo tanks. Opening that valve will produce a positive pressure head on the underside of the intermediate deck. This permits pumping into and out from the lower tank through that deck. This also eliminates the need for venting the lower tank to accommodate expansion or contraction of the cargo. In the event of hull damage, all those valves must be closed to ensure pumping is from damaged tanks only.

These and other related advantages of this invention are realized by providing an intermediate deck at a selected distance below the ship's loaded waterline. That horizontal deck extends through all cargo compartments dividing the ship into upper and lower storage tanks. The upper storage tanks extend from the intermediate deck to the tanker's main top deck. The intermediate deck must have sufficient strength to support the maximum weight of cargo in the storage spaces above it when they are full.

Associated with the intermediate deck may be means for retrieving and directing liquid cargo to and from the storage tanks. For example, with the intermediate decks located below the waterline, a suction connection at that deck will provide a means of retrieving cargo from any compartment that lies below that deck and sustains damage.

DESCRIPTION OF THE PREFERRED EMBODIMENTS

Figure 1A:
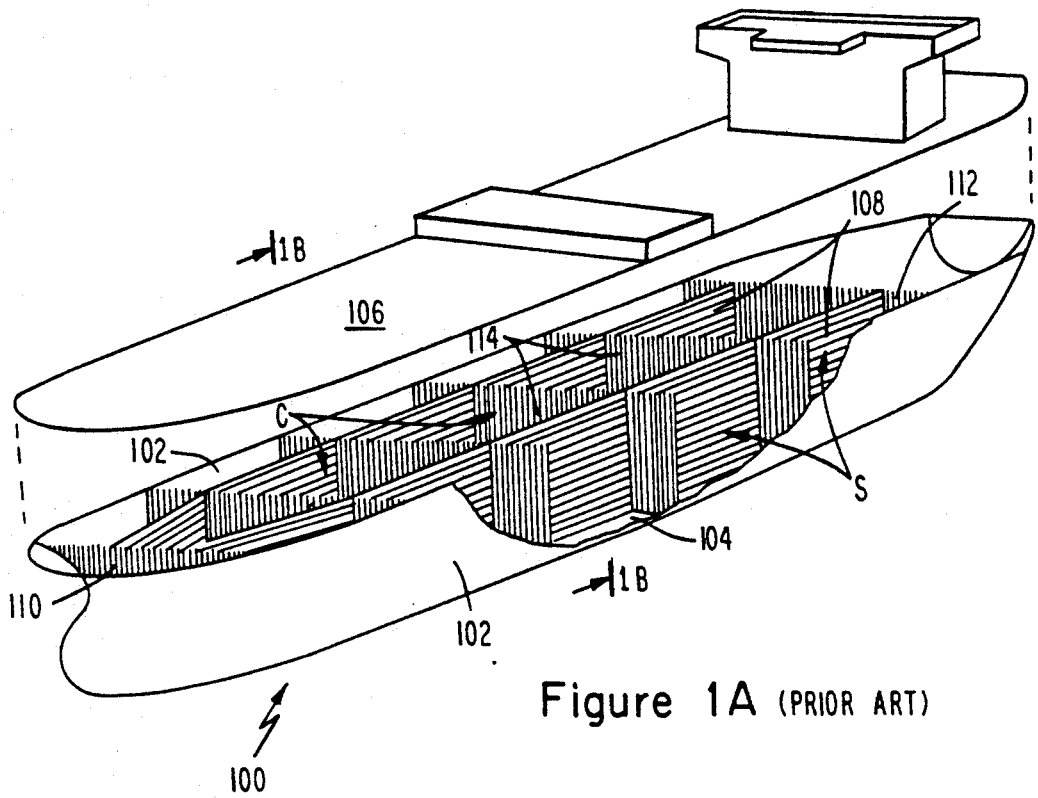
Figure 1A (PRIOR ART)
FIG. 1A is a perspective view of a known structure for a liquid cargo vessel.
Figure 1B:
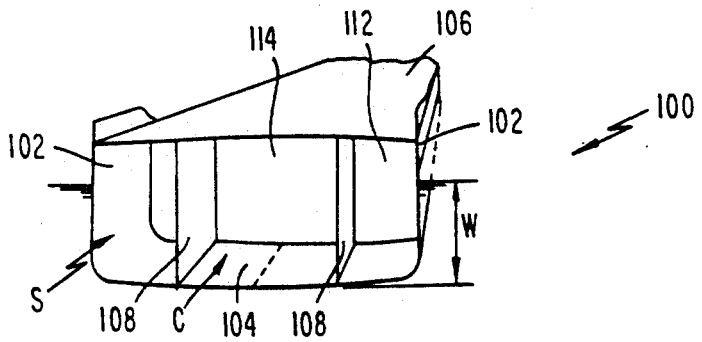
Figure 1B (PRIOR ART)
FIG. 1B is a view taken along the line 1B—1B of FIG. 1A.

FIG. 1A is a cut away perspective view of a known single skin tanker 100 having sides 102 and a bottom 104 and a top deck 106. A cargo space is located between a forward transverse water-tight bulkhead 110 and an aft transverse water-tight bulkhead 112. These end bulkheads 110, 112 extend from side to side to sides 102, 102 and vertically from the ship bottom 104 to the top deck 106. The cargo space is further sub-divided by additional vertical water-tight bulkheads. Two such bulkheads 108 extend longitudinally between the end bulkheads 110, 112 to create a wide central space with two narrower side spaces. These spaces are further subdivided by a plurality of longitudinally spaced transverse bulkheads 114 to form a plurality of middle tanks C and side tanks S. Tanks or compartments C, S may each be utilized to store and transport liquid cargo or, selectively, the outer or side compartments S may be empty or filled with other cargo or even water to serve as ballast. In FIG. 1B, waterline W, corresponding to a fully loaded condition of the vessel, is indicated as being at a vertical distance "W" above the bottom 104 of the vessel 100. If the integrity of bottom 104 is breached between longitudinal bulkheads 108, 108, then the liquid cargo from within inner compartment C will leak out. Similarly, if there is any breach in the integrity of sides 102, 102 or that portion of bottom 104 which defines either one of the outer compartments S, then again liquid cargo from the outer compartments will leak out. Any rupture of either bottom 104 or sides 102, 102 thus would result in the leakage of a substantial volume of liquid cargo.

In the structure disclosed in U.S. Pat. No. 4,241,683, to Conway, as best understood with reference to FIG. 2 herein, the structure illustrated includes at least one horizontal bulkhead 204 disposed between and connected to sides 102, 102, longitudinal bulkheads 108, 108, transverse bulkhead(s) 202, and transverse end bulkheads 112 (as illustrated in FIG. 1A). For the length of the ship between any two adjacent transverse bulkheads, therefore, there will in effect be six cells for containing cargo, these being inner upper cell 206 and outer upper cells 208, 208, inner lower cell 210 and outer lower cells 212, 212. Such cells, as illustrated in FIG. 2, are exemplary, and similar cells are defined between each transverse end bulkhead and the next adjacent transverse bulkhead as well as between adjacent pairs of transverse bulkheads.

Figure 2:
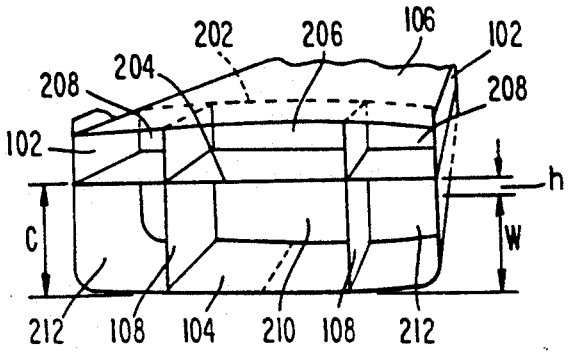
Figure 2 (PRIOR ART)
FIG. 2 is another known structure for a liquid cargo vessel, including a horizontal bulkhead extending between the sides of the ship, the horizontal bulkhead being located at a predetermined height above a waterline of the vessel.

In the prior art according to FIG. 2, the location of horizontal bulkhead 204 with respect to the waterline W is deliberately selected as a function of the specific gravities $S_w$ and $S_c$ which are the respective specific gravities of the water supporting the vessel and the liquid cargo. Specifically, the horizontal bulkhead 204 is disposed to be above the waterline W, at a distance "h" while also satisfying a requirement that a distance C, between the horizontal bulkhead 204 and bottom 104, i.e, the lowest point of the bottom serving as a reference from which the distance is measured, be less than or equal to $H(S_w/S_c)$ H represents the vertical height of the waterline of the vessel above the hull bottom, $S_w$ represents the specific gravity of water, and $S_c$ represents the specific gravity of the liquid cargo.

A consequence of having horizontal bulkheads 204 always at a height above the waterline W corresponding to a fully-loaded condition of the vessel 200 is that whenever there is any breach in the integrity of the vessel sides 102, 102 below the waterline, the liquid cargo at the top of the ruptured cell may be of subatmospheric pressure as soon as some liquid cargo leaks out. All of the liquid cargo below the highest point to which the rupture extends will leak out and be displaced by water pouring in. Due to the head of liquid cargo above the waterline by the distance "h", even more of the liquid cargo may leak out of the rupture. Obviously, if the rupture extends above the waterline then all of the liquid cargo will leak out. Also, if the rupture occurs in sides 102, 102 at locations above horizontal bulkhead 204 then it may be expected that, even if there is no rolling of the vessel due to weather conditions or imbalance, the liquid cargo above the lowest point of the rupture will pour out from the cell having the ruptured side.

In contrast to the known structure of Conway, in the present invention as best understood with reference to FIGS. 3A and 3B, a vessel 300 for carrying a liquid cargo comprises a horizontal safety bulkhead or intermediate deck 302 which is disposed at a height "C" above bottom 304 of the vessel, at a depth "D" below waterline W of the vessel corresponding to its fully-loaded condition. In the preferred embodiment illustrated in FIGS. 3–6, therefore, the depth "W" of bottom 304 with respect to waterline W is greater than the distance "C" between horizontal safety bulkhead 302 and bottom 304 by a distance "D".

For most oil tankers, it is believed that having this distance "D" in the range 5 ft. to 10 ft. will provide the maximum advantage to be realized by the preferred invention. In other words, although horizontal safety bulkhead 302 is constructed in generally the same manner as horizontal bulkhead 204 as taught by Conway, unlike the structure taught by Conway, horizontal safety bulkhead 302 is preferably located between 5 ft. and 10 ft. below the vessel's waterline corresponding to its fully-loaded condition.

Figure 3A:
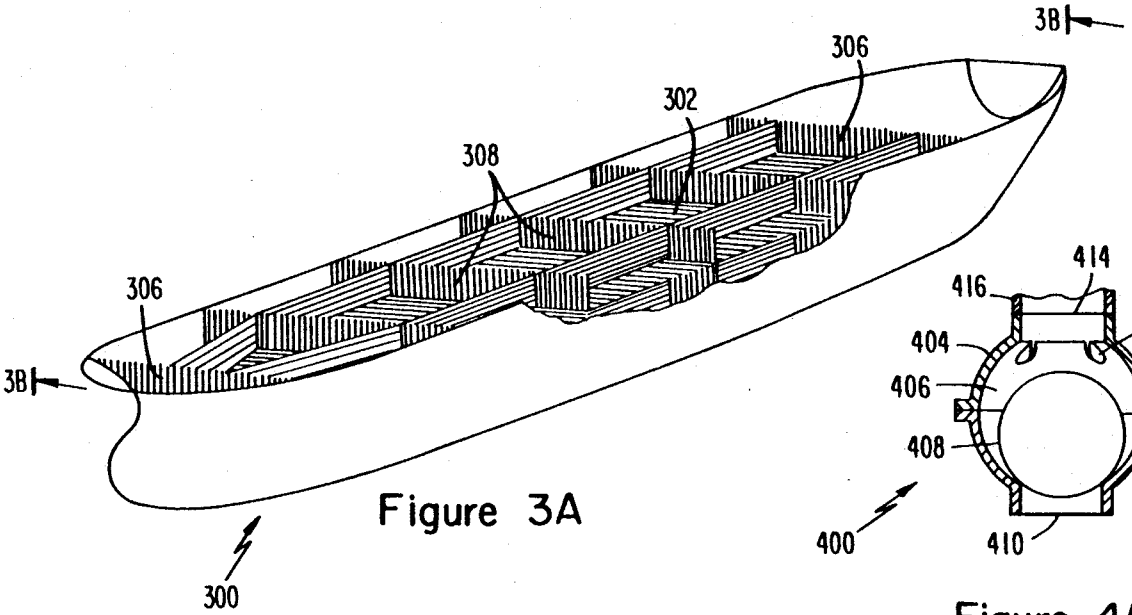
FIG. 3A is a perspective view of a hull identical to that depicted in prior art FIG. 1 but incorporating an improvement feature in accordance with the present invention.
Figure 3B:
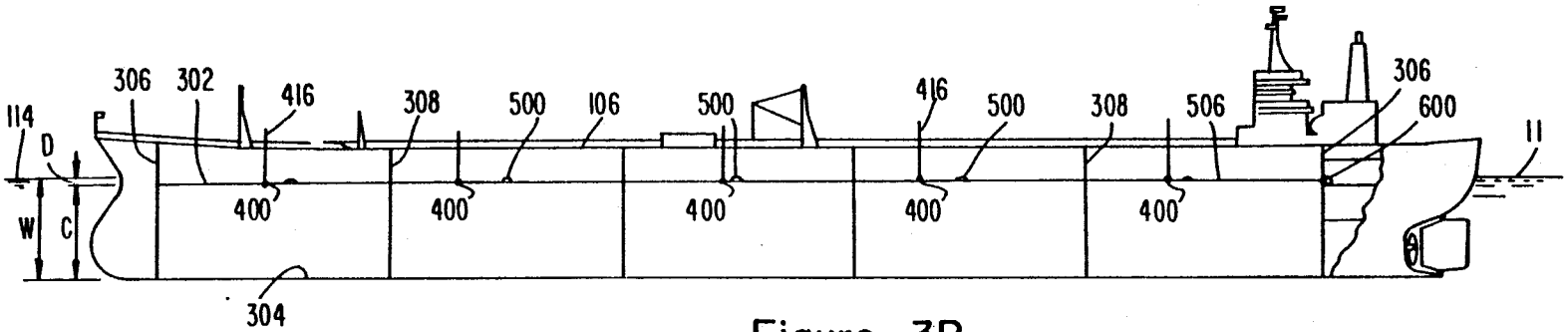
FIG. 3B is a sectional view taken along the line 3B—3B of FIG. 3A.

In FIG. 3B, the horizontal safety bulkhead 302 extends lengthwise of vessel 300 between transverse end bulkheads 306 as well as plural intermediate transverse bulkheads 308. For the sake of simplicity, a separate cross-sectional drawing is not provided for vessel 300 according to the present invention in the same manner as the sectional drawing of FIG. 2. For purposes of illustration and discussion, and with reference to FIG. 2, the inner lower cells and the outer lower cells extending beneath intermediate deck 302 will be referred to by reference numerals 210 and 212, respectively. These cells are virtually identical to the corresponding cells depicted in prior art FIG. 2 except that they have less volume in view of the decreased distance between bottom 104 (304) and intermediate deck 302. In other words, the key difference between prior art FIG. 2 and the invention of FIGS. 3A, 3B is the location of intermediate deck 302 below the waterline W in the present invention whereas the intermediate deck 204 in the prior art figure is located above the waterline W when either vessel is in the fully loaded condition. The various coacting mechanical and structural elements according to this invention will be described in further detail below in connection with FIGS. 4–6.

Figure 4B:
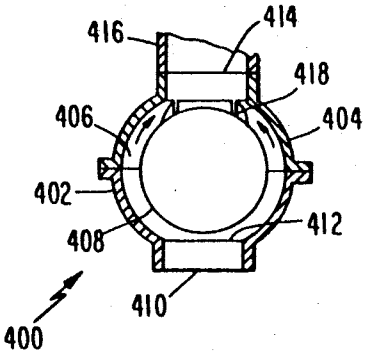
FIGS. 4A and 4B are vertical cross-sectional views of an automatic vent valve of a type suitable for use in the preferred embodiment of this invention, illustrating an inner ball component of the automatic vent valve in its non-venting and its venting positions, respectively.
Figure 4A:
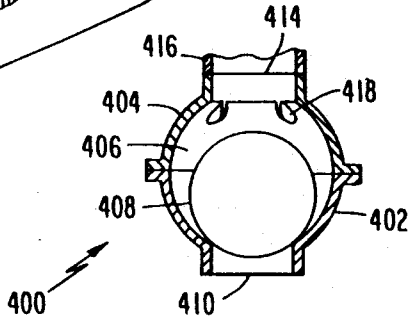

Each of the inner lower cells 210 and the outer lower cells 212 is provided with a vent valve to vent air to atmosphere while the cell is being filled with liquid cargo in the normal course of its use by the use of known pumps, pipes and the like. These known elements are not illustrated only for the sake of simplicity. FIGS. 4A and 4B illustrate one exemplary form of a vent valve suitable for this purpose.

As seen in FIGS. 4A and 4B, a satisfactory form of vent valve 400 has a generally spherical outer casing formed of two fitted-together casing halves 402 and 404 which also define an internal generally spherical inside space 406. Within spherical space 406 is located a spherical ball 408 which may be made of any suitable material which may be solid or hollow depending on the material but must be light enough to float on the liquid cargo, or be pushed up by air, which may arise through lower opening 410 in the casing of check valve 400. As illustrated in FIG. 4A, when vent valve 400 is closed, the ball 408 is seated against a circular sealing rim 412 which is formed in an inside surface of lower casing half 402. Sealing rim 412 has a smaller diameter than ball 408. An upper opening 414 of upper casing half 404 is connected to an upwardly oriented vent pipe 416 (best seen in FIG. 3), to be extended upwardly through the upper inner or outer cells to atmosphere. Thus, when liquid cargo is pumped into any of the lower inner cells 210 or lower outer cells 212 from an outside supply of the liquid cargo to load the vessel, any air that may be present in these lower cells becomes pressurized sufficiently to lift ball 408 above sealing rim 412, as best seen in FIG. 4B.

A plurality of projections 418 are formed around an axis of upper casing half 404 so that when ball 408 is thus lifted above sealing rim 412 the displaced air or gas can pass around the ball 408 as indicated by the curved arrows in FIG. 4B, through spaces between the projections, into vent pipe 416 and thus to atmosphere. Obviously, when a cell being filled with liquid cargo is completely full, there will be a rise in the internal pressure of the cell when it is totally filled with liquid cargo and, using known devices in known manner, the inflow of further liquid cargo is terminated. Details of such known elements are not important to the present invention and are therefore omitted. The ball 408 will drop into a sealing contact with sealing rim 412 to prevent the ingress of air from the atmosphere through vent pipe 416 if, for any reason, the level of the liquid cargo in the vent line drops, e.g., due to suction from the common transfer pump.

Stopping the ingress of air with the vent valve 400 and vent pipe 416 is important to prevent the common pump from pumping cargo from an undamaged tank. Thereby, the common transfer pump will automatically pump cargo from a damaged tank or tanks.

Exactly the same type of vent valve and vent pipe mechanism may be provided to each of the outer upper cells 208, 208. Aspects of the present invention which facilitate such swift extraction of liquid cargo from a ruptured cell, in cooperation with the selected structure forming such cells, is described hereinbelow.

Figure 5:
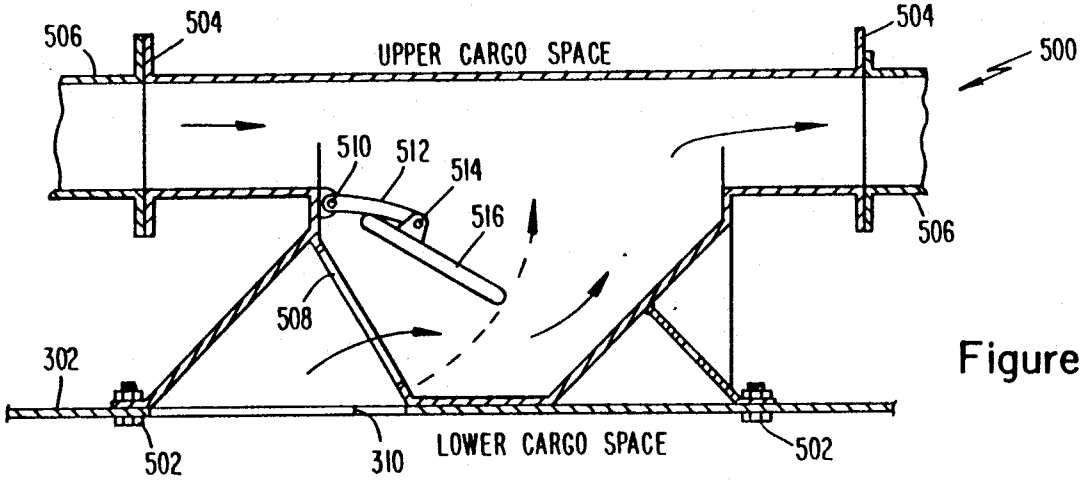
FIG. 5 is a vertical cross-sectional view of a one-way valve in accordance with the preferred embodiment of this invention, mounted to communicate with a lower cargo space at the level of a horizontal safety bulkhead.
Figure 6:
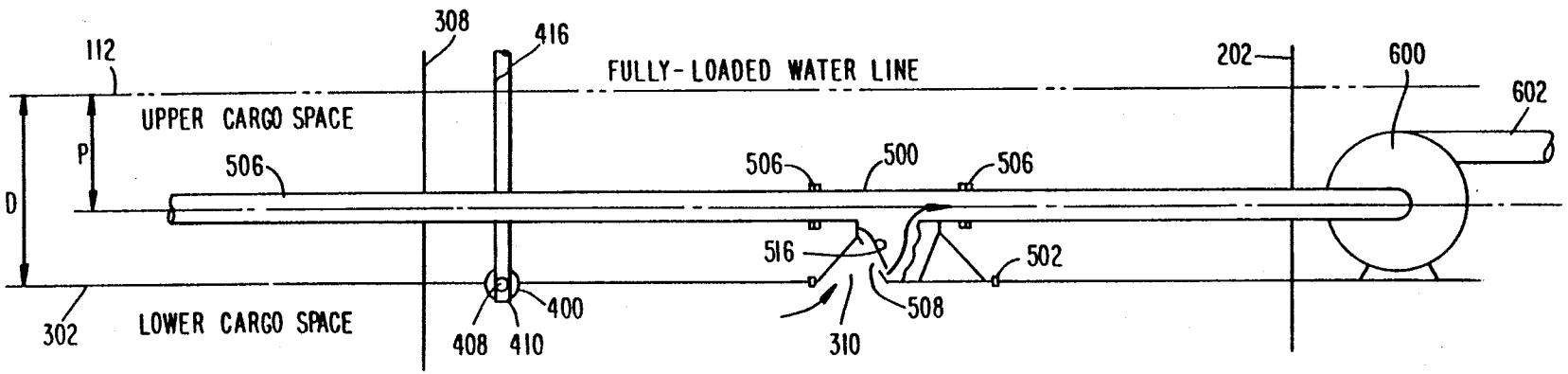
FIG. 6 is a schematic, partially-sectioned, vertical elevation view illustrating in enlarged form a portion of the structure according to a preferred embodiment of this invention at the horizontal safety bulkhead level.

Mounted to an upper surface of horizontal safety bulkhead 302, as best seen with reference to FIGS. 3 and 5, is a plurality of one-way valves 500, there being at least one such one-way valve 500 communicating with each of the inner and outer lower cells through openings 310 in the horizontal safety bulkhead 302 (best seen in FIG. 5). Each one-way valve 500 is mounted by bolts 502 to horizontal safety bulkhead 302 to communicate therewith through a corresponding opening 310 and has a casing having an upper portion with end flanges 504, 504 as indicated in FIG. 5. The spaces above and below horizontal safety bulkhead 302 constitute an upper cargo space and a lower cargo space, respectively. In other words, one-way valve 500 actually occupies a portion of the upper cargo space and, when there is liquid cargo in the upper cargo space one-way valve 500 is immersed therein.

Connected to flanges 504, 504 are correspondingly flanged lengths of a suction line 506. This suction line 506 will actually have a multi-branched appearance in plan view since each of the inner and outer lower cells is connected thereto. Suction line 506 is connected to the inlet of a suction pump 600, best seen in FIG. 6. Operation of suction pump 600 provides a suction through suction line 506 to every one of the individual one-way valves 500 communicating with corresponding individual inner and outer lower cells, for purposes to be explained hereinafter. Any liquid cargo thus sucked by operation of suction pump 600 is delivered thereby through a suction pump outlet 602.

One-way valve 500 is of a known type, and has a body with an internal opening 508 through which passes liquid cargo sucked through opening 310 of horizontal safety bulkhead 302 from the lower cargo space therebelow. Inside the casing of one-way valve 500 there is provided a first pivot 510 at which is pivotally mounted a link 512 having a second pivot 514 at a distal end thereof. Pivotally mounted to second pivot 514 is a valve disk 516 which is illustrated in FIG. 5 in its lifted or open position. Pivoting of link 512 about first pivot 510 causes valve disk 516 to be lifted above and away from internal opening 508 to enable flow of liquid cargo from the lower cargo space therethrough. Second pivot 514 facilitates complete seating of valve disk 516 to fully close opening 508. The broken curved arrow in FIG. 5 generally indicates the manner in which valve disk 516 may be moved from its lowermost position, to its increasingly opened positions. The solid curved arrows in FIG. 5 indicate the direction in which liquid cargo may flow from the lower cargo space, through one-way valve 500 and along suction line 506. It will be appreciated that there is no means provided for directly moving either link 512 or valve disk 516. It is only the application of suction by the operation of suction pump 600 which reduces a pressure in one-way valve 500 and causes valve disk 516 to move to open internal opening 508 when the suction generates an adequate pressure difference between the lower cargo space and the space inside suction line 506 and one-way valve 500.

Under normal operating conditions, with suction pump 600 not operating, the weight of valve disk 516 and link 512 should be sufficient to maintain internal opening 508 of valve 500 closed even when the lower cargo space is entirely full of liquid cargo. Note that because ball 408 in each vent valve 400 is light, when the lower cells are being filled the air displaced therefrom lifts ball 408 easily instead of lifting the heavier valve disk 516. If the liquid cargo is charged initially into the lower cargo space at a substantial pressure, some liquid cargo may have initially forced its way past the gravity-closed valve disk 516, in which case suction line 506 will be either partially or fully charged with liquid cargo.

Various emergency scenarios can now be readily visualized.

For example, if all of the inner and outer lower cells are completely filled with liquid cargo and suction line 506 is also fully charged with liquid cargo, then initiation of operation of suction pump 600 will immediately apply a suction to all portions of suction line 506 and, thereby, to all one-way valves 500 attached thereto. Provided that the vent valves are all working as intended, the lower cargo space will then be put at a pressure below atmospheric, i.e., at a negative pressure with respect to the ambient atmosphere. At this time, if there is any rupture of any lower cell, such a suction will tend to prevent leakage of the liquid cargo and will, instead, suck in water from the outside into the ruptured cell as liquid cargo is sucked out therefrom. With liquid cargo having a density lower than that of such water, the incoming water will upwardly displace liquid cargo within the ruptured cell and operation of suction pump 600 will thus positively and controllably remove the liquid cargo. Note that because horizontal safety bulkhead according to the present invention is disposed below the waterline, the water head above the rupture will assist the suction pump, i.e, such removal of liquid cargo from a ruptured cell will be positively assisted by the presence of water outside the ruptured cell. This is true whether or not the rupture is in the bottom or the side of the ship below horizontal safety bulkhead 302.

With the safety deck 302 below the waterline W, it will be appreciated that little or no oil will be lost from the inner lower tanks even if the suction pumps aren't used. Likewise, the lower side tanks will sustain little or no loss of oil if the damage is limited to the ship bottom.

Figure 7:
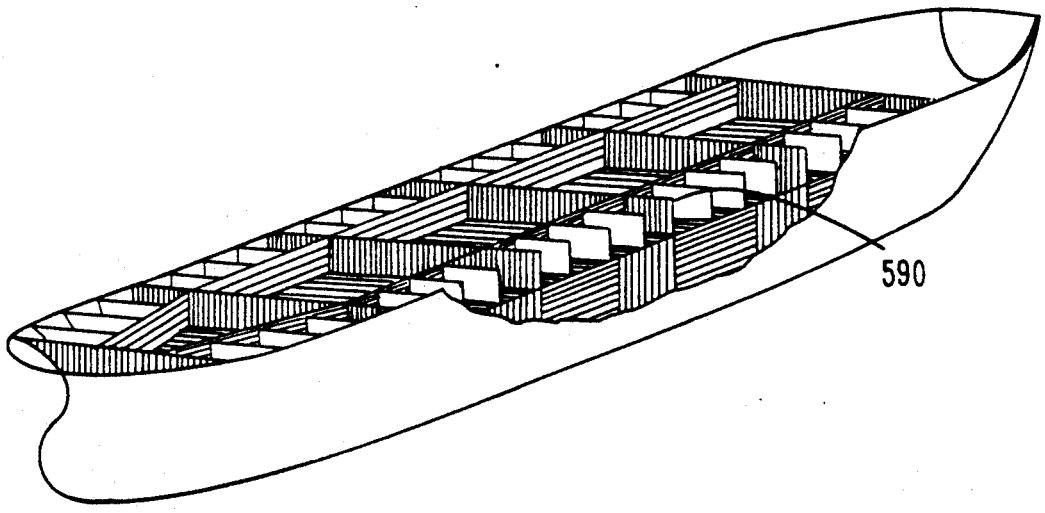
FIG. 7 is perspective view of a further embodiment of the present invention.

FIG. 7 is an illustration of a tanker 300 as depicted in FIG. 3A, but with the upper side tanks further subdivided into smaller upper side compartments by means of additional vertical bulkheads 590. When a ship side is ruptured above the waterline, all the fluid cargo in the damaged compartment above that hole will quickly pour out. By sub-dividing each upper side tank in this manner, the potential loss may be restricted.

To further limit the loss of oil from these upper outboard tanks, there may be provided flexible plastic overlapping curtains that may be suspended a short distance in from the inner surface of sides 102 to extend parallel to the sides. The bottom of these curtains may be weighted (not shown) and their length would somewhat exceed the height of the upper tank. In the event of damage to the upper tank's side, the outflow of oil would draw the curtain against the hole to stem the loss of cargo.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. In a ship for carrying a liquid cargo which has a density less than the density of the water supporting the ship, wherein a space for storing the liquid cargo is defined by a bottom, longitudinal sides, a top deck and two transverse end bulkheads, the storage space extending vertically between the bottom and the top deck, respectively below and above a predetermined waterline corresponding to a fully-loaded condition of the ship, an improvement to prevent substantial leakage of the liquid cargo due to rupture of said sides or bottom, the improvement comprising:

a horizontal safety bulkhead, extending longitudinally and transversely between the longitudinal sides and the transverse end bulkheads and located at a predetermined depth below the predetermined waterline to define an upper storage space extending vertically from the horizontal safety bulkhead to the top deck and a lower storage space extending from the horizontal safety bulkhead to the bottom, wherein the horizontal safety bulkhead is formed to have sufficient strength to fully support the maximum weight of liquid cargo located in the upper storage space independently of any upwardly directed forces acting on the horizontal safety bulkhead which are related to the presence of liquid cargo and any water occupying the lower storage space; and flow means for controllably flowing liquid cargo from the lower storage spaces, wherein:

the flow means comprises suction pump means for providing suction, connected to a suction line fluidly communicating through a one-way valve with the lower space at the level of the horizontal safety bulkhead, and the suction line, the one-way valve and the suction pump means are all located below the waterline.

2. The ship according to claim 1, wherein:

the suction line, the one-way valve and the suction pump means are all located above the horizontal safety bulkhead.

3. The ship according to claim 2, wherein:

the horizontal safety bulkhead is positioned to be located at a depth ranging between 5 ft. and 10 ft. below the waterline.

4. In a ship for carrying a liquid cargo which has a density less than the density of the water supporting the ship, wherein a space for storing the liquid cargo is defined by a bottom, longitudinal sides, a top deck and two transverse end bulkheads, the storage space extending vertically between the bottom and the top deck respectively below and above a predetermined waterline corresponding to a fully-loaded condition of the ship, an improvement to prevent substantial leakage of the liquid cargo due to rupture of said sides or bottom, the improvement comprising:

a horizontal safety bulkhead, extending longitudinally and transversely between the longitudinal sides and the transverse end bulkheads and located at a predetermined depth below the predetermined waterline to define an upper storage space extending vertically from the horizontal safety bulkhead to the top deck and a lower storage space extending from the horizontal safety bulkhead to the bottom, wherein the horizontal safety bulkhead is formed to have sufficient strength to fully support the maximum weight of liquid cargo located in the upper storage space independently of any upwardly directed forces acting on the horizontal safety bulkhead which are related to the presence of liquid cargo and any water occupying the lower storage space; and flow means for controllably flowing liquid cargo from the lower storage spaces; said ship further comprising:

a plurality of intermediate transverse bulkheads spaced between the two transverse end bulkheads and connected to the top deck, the bottom, the longitudinal sides and the horizontal safety bulkhead, to thereby divide the upper and lower storage spaces into corresponding pluralities of upper cells and lower cells for containing liquid cargo located in the divided upper and lower storage spaces respectively, and further comprising means for automatically venting said upper and lower cells, said venting means including check valve means for preventing air from entering said cells therethrough.

5. In a ship for carrying a liquid cargo which has a density less than the density of the water supporting the ship, wherein a space for storing the liquid cargo is defined by a bottom, longitudinal sides, a top deck and two transverse end bulkheads, the storage space extending vertically between the bottom and the top deck respectively below and above a predetermined waterline corresponding to a fully-loaded condition of the ship, an improvement to prevent substantial leakage of the liquid cargo due to rupture of said sides or bottom, the improvement comprising:

a horizontal safety bulkhead, extending longitudinally and transversely between the longitudinal sides and the transverse end bulkheads and located at a predetermined depth below the predetermined waterline to define an upper storage space extending vertically from the horizontal safety bulkhead to the top deck and a lower storage space extending from the horizontal safety bulkhead to the bottom, wherein the horizontal safety bulkhead is formed to have sufficient strength to fully support the maximum weight of liquid cargo located in the upper storage space independently of any upwardly directed forces acting on the horizontal safety bulkhead which are related to the presence of liquid cargo and any water occupying the lower storage space; and flow means for controllably flowing liquid cargo from the lower storage spaces; said ship further comprising:

a plurality of intermediate transverse bulkheads spaced between the two transverse end bulkheads and connected to the top deck, the bottom, the longitudinal sides and the horizontal safety bulkhead, to thereby divide the upper and lower storage spaces into corresponding pluralities of upper cells and lower cells for containing liquid cargo located in the divided upper and lower storage spaces respectively, wherein:

the flow means comprises suction pump means for providing suction, connected to a suction line fluidly communicating through individual one-way valves with each of the plurality of lower cells at the level of the horizontal safety bulkhead, and the suction line, the individual one-way valves and the suction pump means are all located below the waterline.

6. The ship according to claim 5, wherein:

the suction line, the one-way valves and the pump means are all located above the horizontal safety bulkhead.

7. The ship according to claim 6, wherein:

the horizontal safety bulkhead is positioned to be located at a depth ranging between 5 ft. and 10 ft. below the waterline.

8. The ship according to claim 4, further comprising:

two or more inner longitudinally bulkheads symmetrically spaced between the longitudinal sides, each of the inner longitudinal bulkheads extending vertically and being connected to the top deck and the bottom and connected as well to the horizontal safety bulkhead disposed therebetween, each of the inner longitudinal bulkheads also extending longitudinally between and being connected to each of the transverse end bulkheads as well as to the intermediate transverse bulkheads disposed therebetween whereby each of the upper cells is divided into corresponding outer upper cells and at least one inner upper cell, and each of the lower cells is divided into corresponding outer lower cells and at least one inner lower cell, each of the inner and outer lower cells being individually connected to the flow means and being automatically vented.

9. The ship according to claim 8, wherein:

the flow means comprises suction pump means for providing suction, connected to a suction line fluidly communicating through individual one-way valves with each of the plurality of the inner and outer lower cells at the level of the horizontal safety bulkhead, and the suction line, the individual one-way valves and the suction pump means are all located below the waterline.

10. The ship according to claim 9, wherein:

the suction line, the one-way valves and the pump means are all located above the horizontal safety bulkhead.

11. The ship according to claim 10, wherein:

the horizontal safety bulkhead is positioned to be located at a depth ranging between 5 ft. and 10 ft. below the waterline.

12. The ship according to claim 4, further comprising a plurality of additional transverse bulkheads mounted at longitudinally spaced intervals between adjacent said intermediate transverse bulkheads, said additional bulkheads extending only within the upper storage spaces to sub-divide said spaces into additional outer and upper side tanks.

13. The ship according to claim 4, wherein:

the flow means comprises suction pump means for providing suction, connected to a suction line fluidly communicating through individual one-way valves with each of the plurality of lower cells at the level of the horizontal safety bulkhead, and the suction line, the individual one-way valves and the suction pump means are all located below the waterline.

* * * * *